US006302813B1

(12) United States Patent
Sturgeon et al.

(10) Patent No.: US 6,302,813 B1
(45) **Date of Patent: *Oct. 16, 2001**

(54) NOISE MAKING NOVELTY BASEBALL BAT

(76) Inventors: Mark J. Sturgeon; Todd S. Sturgeon, both of 8062 E. Tether Trail, Scottsdale, AZ (US) 85255

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/164,735

(22) Filed: Oct. 1, 1998

(51) Int. Cl.[7] ..... A63B 69/36

(52) U.S. Cl. ..... 473/564; 446/419; 84/402; 473/567

(58) Field of Search ..... 473/564–568, 473/457; D21/211; 84/402, DIG. 21, 410; 446/227, 397, 419

(56) References Cited

U.S. PATENT DOCUMENTS

| | | | | |
|---|---|---|---|---|
| 257,785 | * | 5/1882 | Teter | 446/419 |
| D. 394,686 | | 5/1998 | Krzystofczyk | D21/211 |
| 2,379,006 | | 8/1943 | Johnson | 273/72 |
| 3,137,504 | | 6/1964 | Zordan et al. | 273/26 |
| 3,861,682 | | 1/1975 | Fujii | 273/72 A |
| 3,955,816 | | 5/1976 | Bratt | 273/26 B |
| 4,179,973 | | 12/1979 | White | 84/402 |
| 4,274,631 | | 6/1981 | Hayazaki | 273/26 B |
| 4,454,204 | * | 6/1984 | Posey | 446/419 |
| 4,898,384 | | 2/1990 | Beach | 273/26 R |
| 5,044,250 | | 9/1991 | Beyer | 84/422.4 |
| 5,133,551 | | 7/1992 | Handy et al. | 273/72 R |
| 5,179,255 | | 1/1993 | Yeh | 181/182 |
| 5,265,514 | | 11/1993 | Schertz | 84/422.4 |
| 5,451,047 | | 9/1995 | Liu | 273/72 R |
| 5,533,723 | | 7/1996 | Baum | 273/72 R |
| 5,590,875 | | 1/1997 | Young | 473/457 |

FOREIGN PATENT DOCUMENTS

| | | | |
|---|---|---|---|
| WO92/18207 | 10/1992 | (WO) | A63B/59/06 |
| WO93/23122 | 11/1993 | (WO) | A63B/59/06 |

* cited by examiner

*Primary Examiner*—Mark S. Graham
(74) *Attorney, Agent, or Firm*—Snell & Wilmer L.L.P.

(57) ABSTRACT

A souvenir or keepsake baseball bat for baseball fans including young children. The souvenir baseball bat is approximately one-third the size of an actual baseball bat in length and dimension and includes a hollowed out portion that is filled with beans, beads, buckshot or the like which causes the souvenir bat to rattle when waved or shaken.

17 Claims, 1 Drawing Sheet

FIG. 1
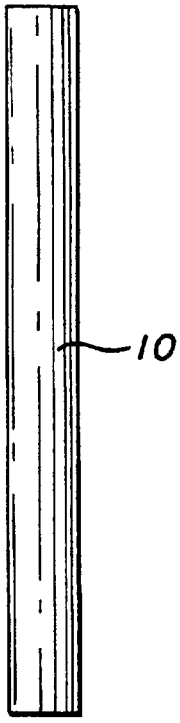
FIG. 2
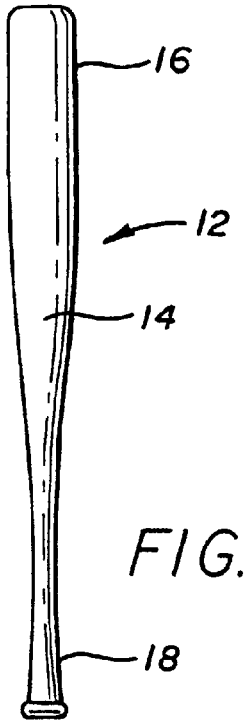
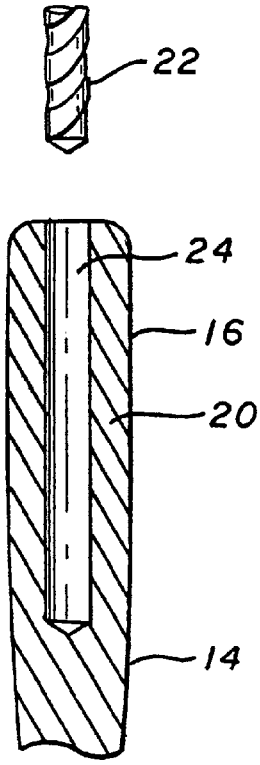
FIG. 3
FIG. 4
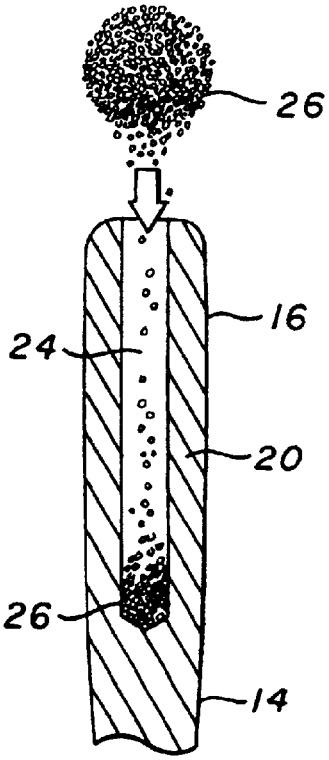
FIG. 5
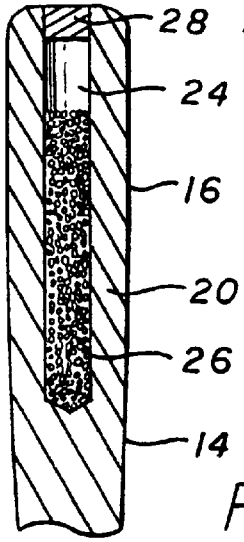
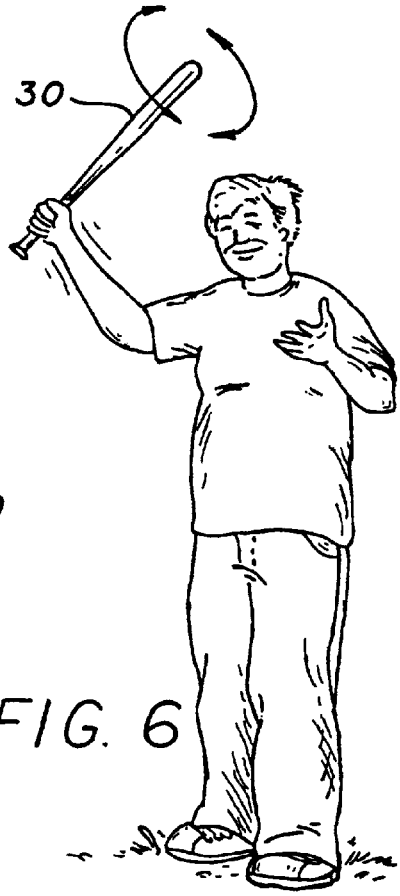
FIG. 6

NOISE MAKING NOVELTY BASEBALL BAT

FIELD OF THE INVENTION

The present invention generally relates to a novelty baseball bat. More particularly, the present invention relates to a novelty baseball bat that is smaller in size than a regular baseball bat wherein the interior of the bat includes a hollowed out portion that contains a plurality of beans, beads, buckshot, pellets or the like which causes the novelty baseball bat to rattle when shaken.

BACKGROUND OF THE INVENTION

Baseball is one of America's most popular spectator sports. As a result, numerous novelty items directed to the game of baseball have been produced and mass marketed. Many of these novelty items are offered for sale at baseball parks around the nation. One such novelty item is a reduced size baseball bat, typically about one-third the size of an actual baseball bat, that is painted or decorated with the colors of a particular baseball team. These novelty type baseball bats are reduced to about one-third the size of a regular baseball bat in both length and dimension to produce a small sized novelty baseball bat that can be easily handled by young children. These small sized novelty baseball bats are primarily designed as souvenirs or keepsakes for young fans and do not perform any real functional use.

One popular pastime of baseball fans attending baseball games is to cheer their favored team. Most times, baseball fans yell or clap when cheering on their team. Sometimes, baseball fans bring whistles and other noise making devices in an effort to produce a distinguishable sound that will stand out amongst the cheers of other baseball fans.

The present invention contemplates providing a souvenir or keepsake novelty baseball bat that is capable of producing sound or noise to aid a baseball fan in cheering for his or her favored team. The goal of the present invention is to provide a souvenir or novelty baseball bat that can specifically provide a rattle like noise in an effort to enlist fan participation in cheering for a favored team.

SUMMARY OF THE INVENTION

It is a principal object of the present invention to provide a souvenir or keepsake novelty baseball bat for baseball fans of all ages.

It is another object of the present invention to provide a souvenir or keepsake novelty baseball bat that is capable of producing sound or noise in order to aid baseball fans of all ages in cheering on their favored team.

It is a further object of the present invention to provide a sound or noise producing souvenir or keepsake novelty baseball bat that brings enjoyment and fun to spectators and baseball fans during the course of a baseball game.

It is still a further object of the present invention to provide a noise producing souvenir or keepsake novelty baseball bat that can be manipulated by young baseball fans to produce sound or noise when cheering on their favored team during a baseball game.

It is yet a further object of the present invention is to provide a sound or noise producing souvenir or keepsake novelty baseball bat that specifically produces a rattle like sound like that of a rattle snake.

Still another object of the present invention is to provide a sound or noise producing souvenir or keepsake novelty baseball bat that can be easily manufactured and mass produced.

Yet another object of the present invention is to produce a sound or noise producing souvenir or keepsake novelty baseball bat that is low cost and durable.

According to a broad aspect of the invention, there is provided a sound or noise producing souvenir or keepsake novelty baseball bat that includes a small sized baseball bat that is reduced in length and dimension to about one-third the size of an actual baseball bat wherein the reduced size baseball bat includes a body having a handle end and a batting or striking end wherein the batting or striking end contains a hollow portion that is partially filled with a plurality of beans, beads, buckshot, pellets or the like. The hollowed out portion of the striking end is partially filled with the beans, beads, buckshot, pellets or the like such that the movement of the souvenir or keepsake novelty baseball bat causes the beans, beads, buckshot, pellets or the like to move within the hollow portion of the body thereby producing a noise or sound.

The sound produced by the movement of the body of the novelty baseball bat is preferably a rattle like sound which is best achieved by partially filling the hollow portion of the body with buckshot. The outside surface of the souvenir or keepsake novelty baseball bat may also be painted to exhibit favored team colors and logos.

BRIEF DESCRIPTION OF THE DRAWINGS

The present invention will hereinafter be described in conjunction with the appended drawing figures, wherein like numerals denote like elements, and:

FIG. 1 is a front elevational view of a starting piece of wood or other material for shaping into a reduced size souvenir or keepsake novelty baseball bat that is reduced in both length and dimension.

FIG. 2 is a front elevational view of a reduced size souvenir or keepsake novelty baseball bat that has been formed from the starting piece of material shown in FIG. 1.

FIG. 3 is a partial cross-sectional view of the striking end of the reduced size souvenir or keepsake novelty baseball bat depicted in FIG. 2, shown with a front elevational view of a drill bit used for drilling out a portion of the core of the souvenir or keepsake novelty baseball bat.

FIG. 4 is a partial cross-sectional view of the striking end of the reduced size souvenir or keepsake novelty baseball bat as illustrated in FIG. 3, shown with plurality of beads or buckshot being used to fill the hollow portion of the striking end of the body of the souvenir or keepsake novelty baseball bat.

FIG. 5 is a cross sectional view of the striking end of the reduced size souvenir or keepsake novelty baseball bat of the present invention showing the beads or buckshot contained and enclosed within the striking end of the novelty baseball bat.

FIG. 6 illustrates the sound or noise producing souvenir or keepsake novelty baseball bat of the present invention being waved by a baseball fan.

DETAILED DESCRIPTION OF THE PREFERRED EMBODIMENT

In accordance with the preferred embodiment of the present invention, there is illustrated throughout FIGS. 1 through 6 a sound or noise producing souvenir or keepsake novelty baseball bat that is reduced in length and dimension to about one-third the size of an actual baseball bat. Although FIGS. 1 through 5 illustrate the production of the preferred embodiment of the sound or noise producing souvenir or keepsake novelty baseball bat of the present invention, it should be understood that FIGS. 1 through 5 exemplify only one method for making the preferred embodiment of the present invention. It is also specifically contemplated by the inventors to mass produce the preferred embodiment of the present invention in the form of a plastic and/or other polycarbonates, polyesters and polyethylenes using injection molding techniques and any other suitable molding techniques capable of producing the souvenir or keepsake novelty baseball bat of the present invention.

As previously stated, FIGS. 1 through 5 illustrate one method for forming the sound or noise producing souvenir or keepsake novelty baseball bat of the present invention wherein a core of the material comprising the body of the novelty baseball bat of the present invention is removed to form a hollowed out portion contained within the body. Turning now to FIG. 1, there is shown a front elevational view of a starting piece 10 of wood or other durable material, such as plastic or rubber, which is shaped into a reduced size souvenir or keepsake novelty baseball bat that is reduced in both length and dimension. The starting piece 10 is of a size which already represents approximately one-third the size of an actual baseball bat in both length and dimension. The starting piece 10 is then shaped into the form of a reduced size baseball bat 12 shown in FIG. 2. The reduced size baseball bat 12 comprises a body 14 having a striking end 16 and a handle end 18.

In order to form the sound or noise producing souvenir or keepsake novelty baseball bat of the present invention, a portion of the core 20 of the body 14 is removed at its striking end 16 as shown in FIG. 3. In one example method for making the sound or noise producing souvenir or keepsake novelty baseball bat of the present invention shown in FIGS. 1 through 5, a drill bit 22 is attached to a drill (not shown). The drill bit 22 is then used to drill out a portion of the core 20 of the body of the reduced size baseball bat shown in FIG. 2. This drilling process results in a reduced size baseball bat having hollow portion 24 located within its striking end 16.

As illustrated in FIG. 4, a predetermined amount of beads or buckshot 26 are then introduced into the hollow portion 24 of the body 20 at its striking end 16. The plurality of beads or buckshot may also take the form of a plurality of beans, pellets or the like so long as they are capable of producing a sound when moved within a confined housing. As shown in FIG. 5, the plurality of beads or buckshot 26 are placed within the hollow portion 24 of the body 14 at its striking end 16 such that they fill over half of the space contained within the hollow portion 24. It is important to ensure that the beads or buckshot 26 do not fill the entire hollow portion 24 of the body 14 at its striking end 16 so that the beads or buckshot 26 are capable of moving within the hollow portion 24 once it is contained. Preferably, the beads of buckshot 26 fill approximately two-thirds to three-quarters of the hollow portion 24 thereby producing a rattle like sound when the sound or noise producing souvenir or keepsake novelty baseball bat of the present invention is waved or shook. Finally, a seal or plug 28 is inserted in the open end of the hollow portion 24 to seal the beads or buckshot 26 within the hollow portion 24.

As previously described, it should be understood that many other methods for making the sound or noise producing souvenir or keepsake novelty baseball bat of the present invention may be employed. The method shown and described in FIGS. 1 through 5 is for illustration purposes only and is not meant to limit the scope of the invention in any way.

FIG. 6 illustrates the sound or noise producing souvenir or keepsake novelty baseball bat 30 of the present invention being waved by a baseball fan. When waved or shaken, the sound or noise producing souvenir or keepsake novelty baseball bat of the present invention preferably makes a rattle like sound.

While the invention has been described and disclosed with reference to the preferred embodiment, those skilled in the art will understand and appreciate that variations in the basic design or substitution of materials may be made, but still fall within the intended scope of the invention, which is to be limited only by the claims appended hereto.

We claim:

1. A noise making novelty baseball bat comprising:

a reduced size body having a striking end and a handle end wherein said striking end includes a hollow portion contained therein;

a plurality of pellets contained within said hollow portion of said striking end such that said plurality of pellets fill at least one-half of said hollow portion of said striking end; and a plug inserted in an open end of said hollow portion such that said plug is flush with said open end of said striking end to seal said plurality of pellets within said hollow portion of said striking end.

2. The noise making novelty baseball bat of claim 1 wherein said plurality of pellets are contained only within said hollow portion of said striking end and comprise at least one of beads, beans and buckshot.

3. The noise making novelty baseball bat of claim 1 wherein said reduced size body is approximately one-third of a size in length and dimension as that of a regular size baseball bat.

4. The noise making novelty baseball bat of claim 1 wherein said body is comprised of at least one of a plastic material, a wood material, a steel material, an aluminum material, a concrete material, a plaster material, and a rubber material.

5. The noise making novelty baseball bat of claim 1 wherein said body is made by injection molding a plastic material.

6. The noise making novelty baseball bat of claim 5 wherein said plastic material comprises at least one of a polycarbonate, a polyester and a polyethylene.

7. A method for producing a noise making novelty baseball bat comprising the steps of:

injection molding a reduced size body having a striking end and a handle end wherein said striking end includes a hollow portion contained therein;

introducing a plurality of pellets into said hollow portion of said striking end such that said plurality of pellets fills at least half of said hollow portion of said striking end; and sealing said hollow portion of said striking end with a plug flush to an end of said striking end such that said plurality of pellets are permanently contained within said hollow portion of said striking end.

8. The method of claim 7 wherein said reduced size body is approximately one-third of a size in length and dimension as that of a regular size baseball bat.

9. The method of claim 7 wherein said body is comprised of at least one of a plastic material, a wood material, a steel material, an aluminum material, a concrete material, a plaster material, and a rubber material.

10. The method of claim 7 wherein said body is made by injection molding a plastic material.

11. The method of claim 10 wherein said plastic material comprises at least one of a polycarbonate, a polyester and a polyethylene.

12. A method for producing a noise making novelty baseball bat comprising the steps of:

drilling a core of material from a reduced size body having a striking end and a handle end creating a hollow portion contained within said striking end;

introducing a plurality of pellets into said hollow portion of said striking end such that said plurality of pellets fills at least half of said hollow portion of said striking end; and sealing said hollow portion of said striking end with a plug flush to an end of said striking end such that said plurality of pellets are permanently contained within said hollow portion of said striking end.

13. The method of claim 12 wherein said plurality of pellets comprise at least one of beads, beans and buckshot.

14. The method of claim 12 wherein said reduced size body is approximately one-third of a size in length and dimension as that of a regular size baseball bat.

15. The method of claim 12 wherein said body is comprised of at least one of a plastic material, a wood material, a steel material, an aluminum material, a concrete material, a plaster material, and a rubber material.

16. The method of claim 12 wherein said body is made by injection molding a plastic material.

17. The method of claim 16 wherein said plastic material comprises at least one of a polycarbonate, a polyester and a polyethylene.

* * * * *